United States Patent [19]

Melehan

[11] 4,201,028

[45] May 6, 1980

[54] APPARATUS FOR APPLYING END CAPS TO ROLLS OF SHEET STOCK

[75] Inventor: George Melehan, Downers Grove, Ill.

[73] Assignee: Chippewa Paper Products Corporation, Hillside, Ill.

[21] Appl. No.: 833,437

[22] Filed: Sep. 15, 1977

[51] Int. Cl.[2] ..... B65B 49/08

[52] U.S. Cl. ..... 53/137; 53/297; 53/380

[58] Field of Search ..... 53/42, 137, 176, 221, 53/222, 290, 296, 297, 298, 341, 359, 357, 367, 380, 211; 93/55.1 R

[56] References Cited

U.S. PATENT DOCUMENTS

| | | | |
|---|---|---|---|
| 985,803 | 3/1911 | Hodgkinson | 53/298 X |
| 1,219,791 | 3/1917 | Tevander | 53/341 |
| 1,689,430 | 10/1928 | Gwinn | 53/137 X |
| 1,871,765 | 8/1932 | Williamson | 53/137 X |
| 2,012,304 | 8/1935 | Dixon | 53/137 |
| 2,190,509 | 2/1940 | Baum | 53/297 X |
| 2,422,408 | 6/1947 | Greenbaum | 53/221 |
| 2,674,074 | 4/1959 | Lancaster et al. | 53/137 |
| 2,905,066 | 9/1959 | Winkler | 53/297 X |
| 3,393,492 | 7/1968 | Lamon et al. | 53/137 |
| 3,633,335 | 1/1972 | Johnson | 53/380 |

FOREIGN PATENT DOCUMENTS

| | | | |
|---|---|---|---|
| 1010003 | 6/1957 | Fed. Rep. of Germany | 53/358 |

*Primary Examiner*—John Sipos

*Attorney, Agent, or Firm*—Michael G. Berkman

[57] ABSTRACT

Apparatus for supporting a roll of sheet stock and for applying end caps at opposed ends of the roll. The device includes rotatable, axially shiftable end assembly means positionable selectively to accommodate rolls of different overall lengths. Means are provided for holding capping discs in position preparatory to shaping or forming the discs into end-capping elements.

2 Claims, 22 Drawing Figures

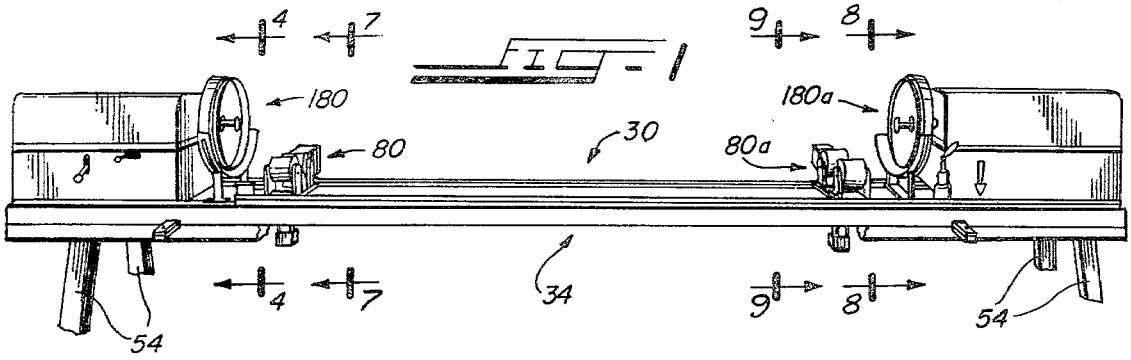
FIG-1
FIG-2
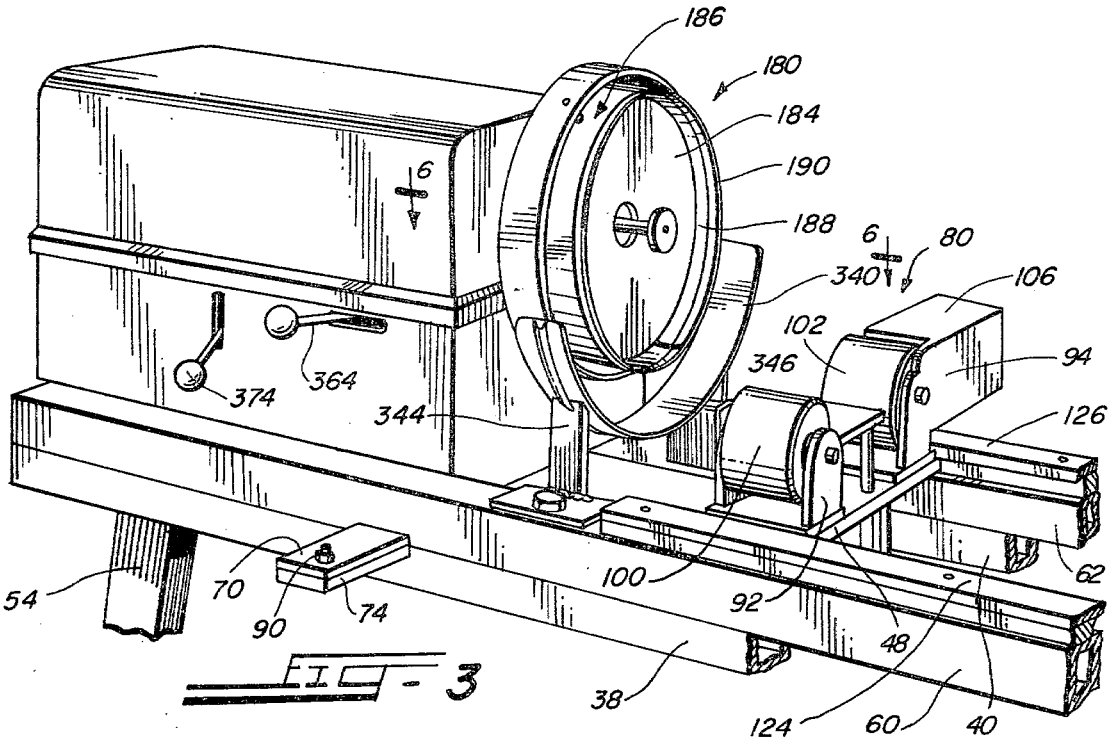
FIG-3
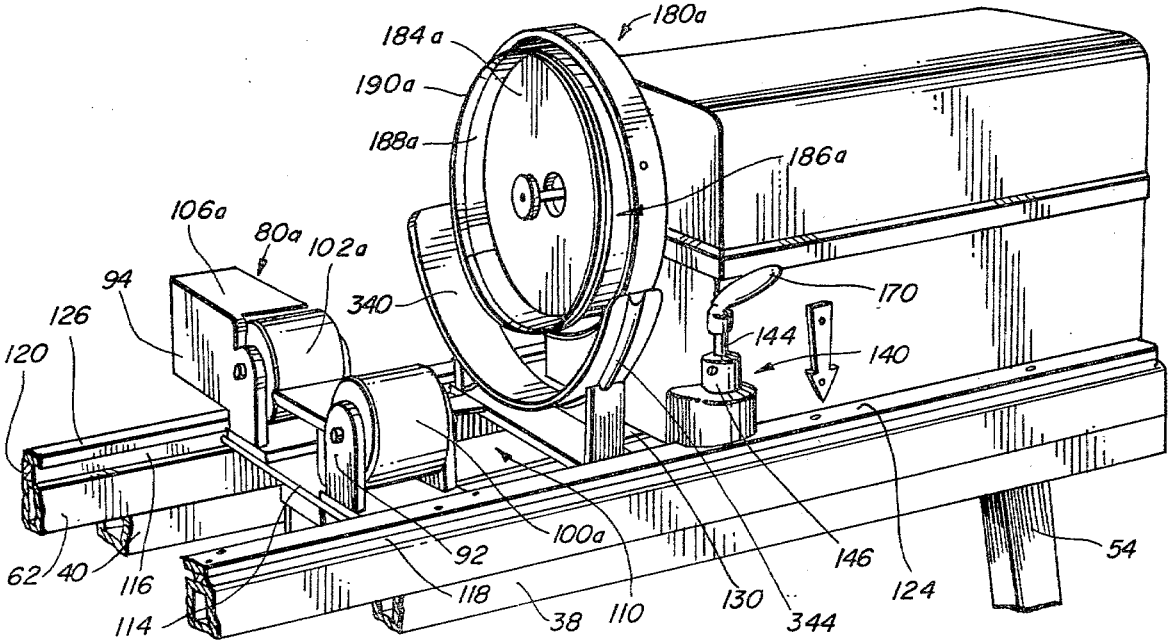

APPARATUS FOR APPLYING END CAPS TO ROLLS OF SHEET STOCK

BACKGROUND OF THE INVENTION

Various types of roll sheet stock are used in industry. These rolls must be transported from the manufacturer to a converter, distributor, seller, or ultimate user. In such shipment, the ends of the rolls are subject to damage resulting in rolls which are unsalable and which may be unsuitable for their intended uses.

It is known to apply protective caps to the ends of rolled sheet stock to prevent damage. For the most part, such protective end caps are applied by hand using procedures which are time consuming and costly. While semi-automatic equipment has been proposed, because of complexity or because of an inability to accommodate rolls of different sizes and lengths, such apparatus has not been accepted in the trade. It is, therefore, a principal aim of the present invention to obviate the shortcomings of existing apparatus and methods and to provide a simple yet highly versatile apparatus for applying protective end caps to rolls of sheet stock.

BRIEF DESCRIPTION OF THE INVENTION

The present invention relates to apparatus for applying, automatically, protective end caps to the opposed ends of rolls of sheet stock. More particularly, the invention is directed to a highly versatile, adaptable machine which may be selectively adjusted to accommodate rolls of sheet stock of various lengths, and which is capable of applying protective end caps to the ends of such rolls.

An important feature of the invention is that the entire capping operation is carried out with minimum manipulation of the heavy rolls once positioned on the apparatus of the invention.

Yet another feature of the invention is that there is provided means for supporting a disc in position for application to and forming about the end of a roll of sheet stock. The disc is held automatically, without need for manual assist.

A related feature of the invention is the elimination of any requirement for manual contact with the end structures of the roll during the application of the end caps, thereby minimizing hazards and avoiding personal injury.

In a particular preferred embodiment of the invention the elongated, heavy roll of sheet stock is carried on low-friction supports to facilitate rotation for end taping.

Yet another feature of the invention includes pneumatic or hydraulic means for lifting the roll of stock to clear its cradle support upon completion of the end-cap-applying operations.

A related feature of the invention is that interlock means are provided to obviate lifting of the roll stock from the cradle until the end-capping assemblies have retracted from and have cleared the roll.

Other and further features, aims and advantages of the invention will become evident upon a reading of the specification considered in conjunction with the drawings.

BRIEF DESCRIPTION OF THE DRAWINGS

FIG. 1 is a front perspective, overall view of apparatus embodying the present invention for applying protective caps to the ends of rolls of sheet stock;

FIG. 2 is an enlarged fragmentary view showing one end of the apparatus of the invention including a cradle upon which the roll stock is supported, and the mechanism for applying an end cap disc to one end of a roll;

FIG. 3 is an enlarged fragmentary perspective view similar to FIG. 2 but showing the opposite end of the apparatus;

DETAILED DESCRIPTION OF PREFERRED EMBODIMENTS

Figure 4:
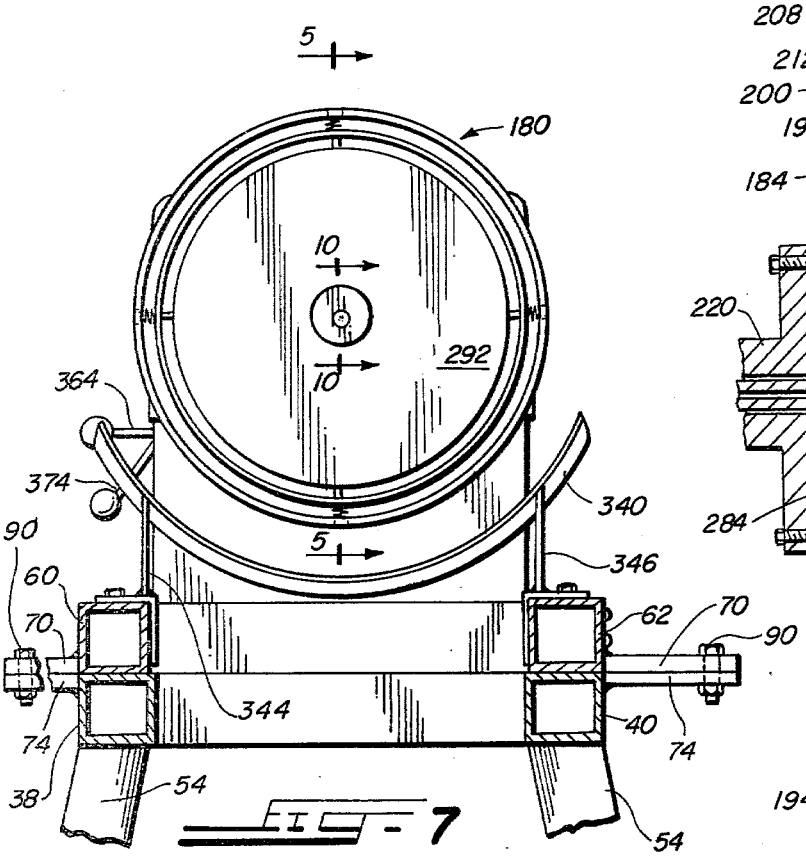
FIG. 4 is an end view taken substantially on the lines 4—4 of FIG. 1 and showing the mechanism for supporting the disc, and the apparatus for applying the disc as an end cap on the roll.

The aims and objects of the invention are realized in accordance with a preferred embodiment of the invention, by providing a frame-carried cradle for supporting a roll of sheet stock in a generally horizontal disposition. The frame also carries a pair of end-capping assemblies which include rotatable and shiftable end plates including means for moving the plates to engage against and to recede from the end faces of the supported roll, thereby to apply and to shape an end cap over each end of the roll. The end-capping assemblies include vacuum plates for supporting protective discs to be applied and formed into end caps. Cups which shape the discs to form end caps are conveniently selectable as to size to accommodate rolls of various diameters. After discs have been applied to the ends of the roll, a band or tape is wrapped around the marginal circumferential end of the roll to hold the end cap to place. Hydraulic or pneumatic means are used to lift the capped and taped roll from its supporting cradle for delivery to a pallet or other carrier.

Referring now to the drawings, and particularly to FIGS. 1-9, for purposes of disclosure, the end-cap-applying apparatus 30 of the invention is shown supported on an elongated, generally horizontally extending frame 34 having forward and rear base channels or beams 38 and 40, bridging rails or cross channels 48, and support legs 54. A second set of channels (FIG. 4) 60 and 62 superimposed on respective lower forward and rear channels 38 and 40 is secured at overlying and aligned flanges 70 and 74 by nut and bolt assemblies 90. (FIGS. 4,6,8 and 9).

Figure 7:
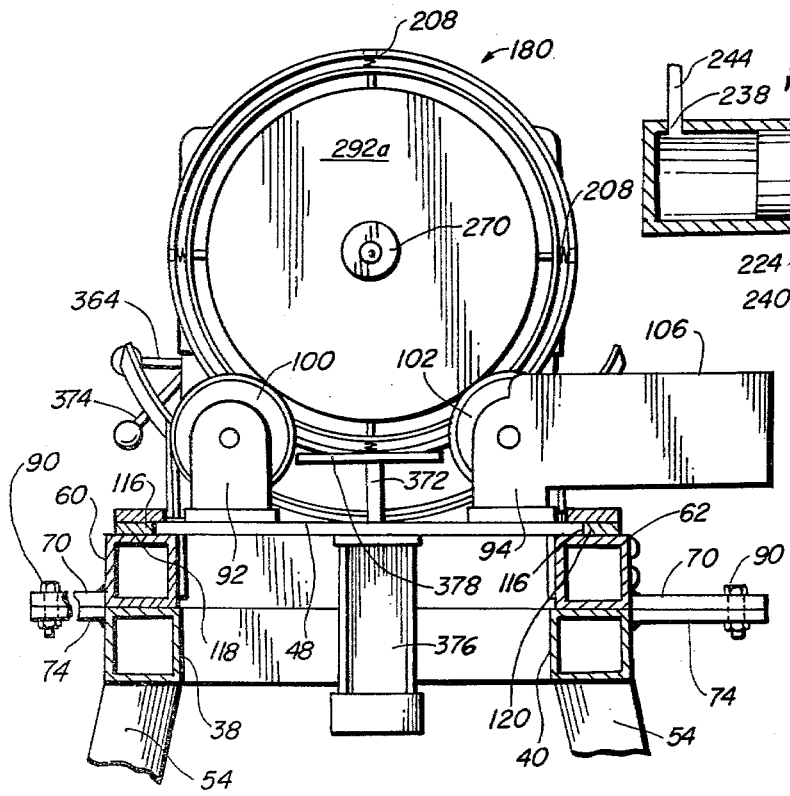
FIG. 7 is an end view taken substantially on the lines 7—7 of FIG. 1 and showing a cradle assembly for supporting one end of the roll, and apparatus for applying the disc as an end cap.

A pair of cradle-like roll-supporting brackets or assemblies 80 and **80*a* are supported at longitudinally spaced positions on the frame 34 of the apparatus. As shown in FIGS. 2 and 7, the left cradle assembly 80 is carried on a cross plate 48 fastened to the upper channels 60 and 62. The left cradle assembly 80, including the support plate 48, is locked against lateral shifting on the frame 34**.

The fixed cross plate 48 carries a pair of bearing bases 92 and 94 rotatably supporting bearings 100, 102 on which one end of the roll rests. The rear bearing base 94 is integrally formed with a rearwardly extending, roll-supporting web 106.

As shown in FIGS. 3 and 7 the second roll stock supporting assembly **80*a* includes all of the functional components described above, each element being identified by the same number but with the suffix "a". However, whereas the left end support assembly 80 is fixed on the frame 34, the right hand assembly 80*a* is selectively shiftable longitudinally along the frame 34 so that the apparatus may be adjusted to accommodate roll stock of various lengths. Specifically, the right end of the apparatus includes a movable platform assembly 110 (FIG. 3) including a cross plate 114 supporting a pair of bearing blocks 92*a* and 94*a* and associated rollers 100*a* and 102*a*. The cross plate 114 rests on and is slidable on the forward and rear horizontally extending frame channels 60 and 62 to move in a slide slot 116 between opposed guide rails 118 and 120 and capped by a pair of hold-down rails 124 and 126**.

Figure 11:
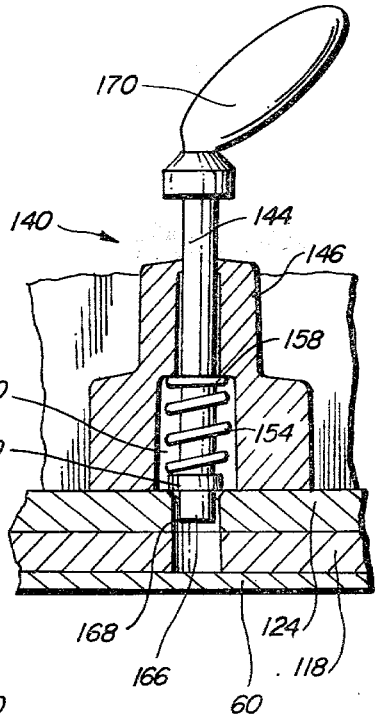
FIG. 11 is an enlarged, cross-sectional, fragmentary view illustrating the mechanism by which the laterally shiftable end-capping assembly at the right end of the apparatus is locked at selectable positions along the rail to accommodate rolls of different lengths.
Figure 12:
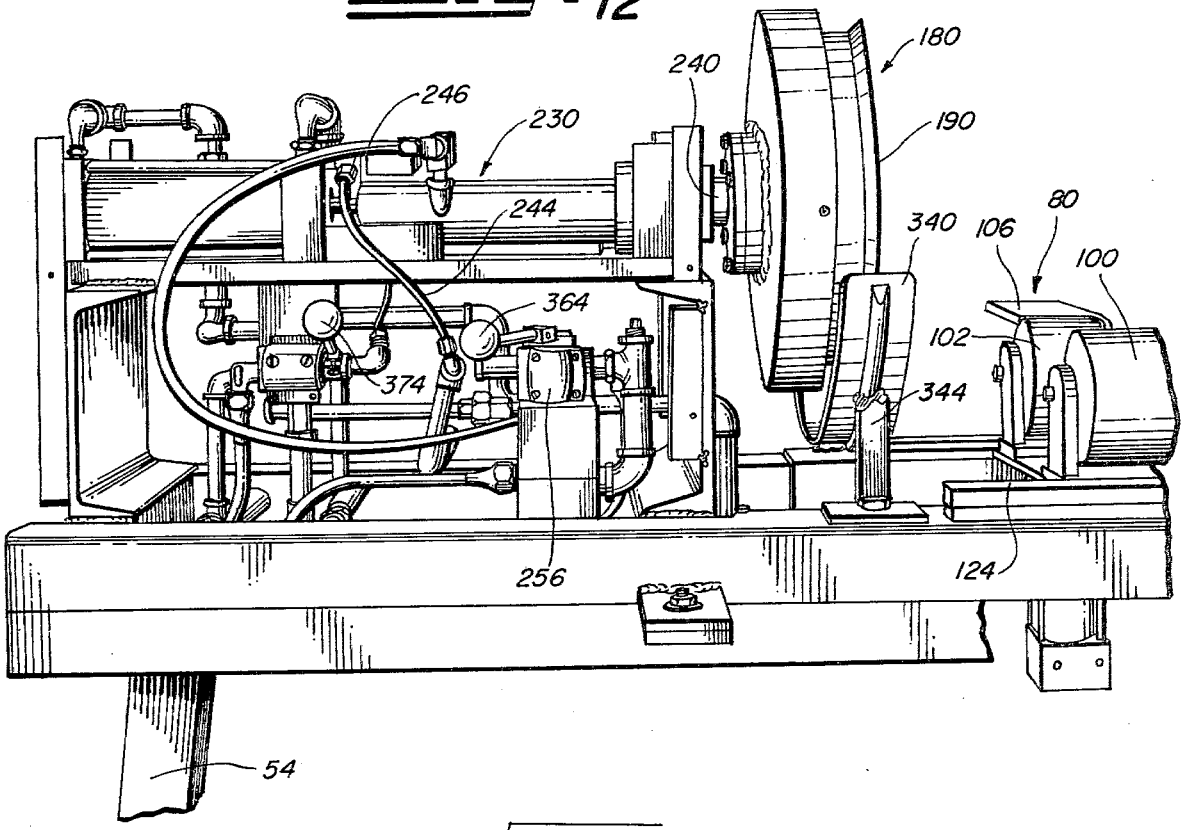
FIG. 12 is a general perspective view of the left end section of the apparatus with covers removed and showing generally the arrangement of piping, valves and switches for operating the end-capping assemblies.
Figure 13:
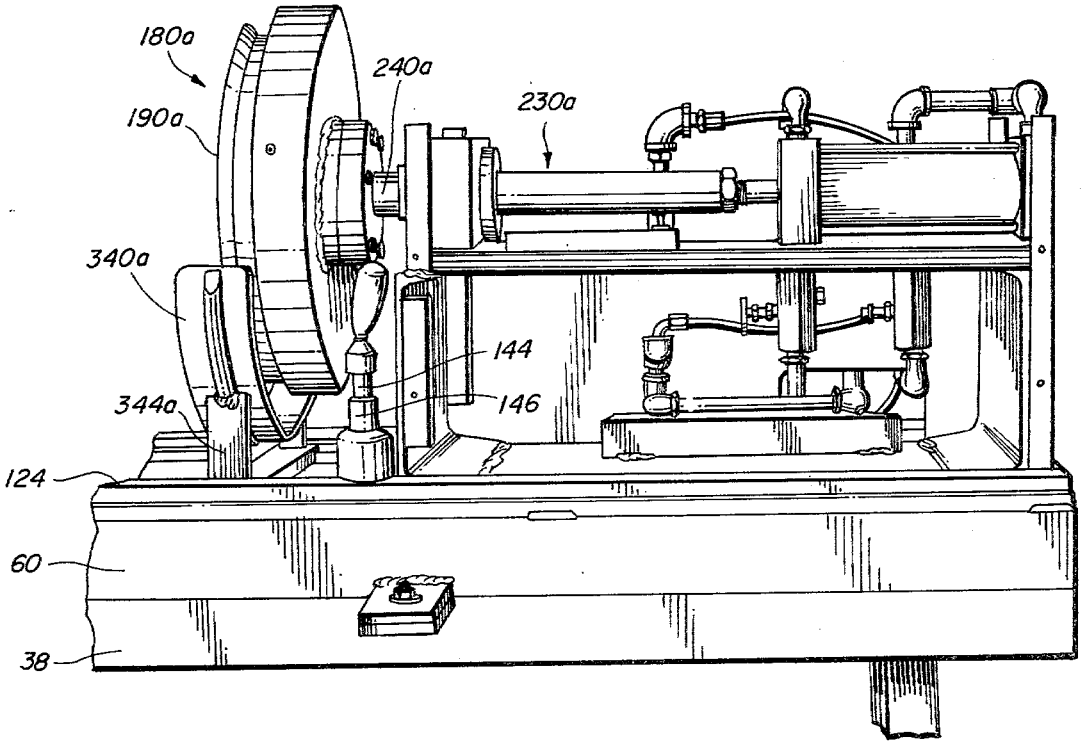
FIG. 13 is a perspective view similar to FIG. 11 showing the interconnection of valves and piping at the right end of the apparatus.
Figure 14:
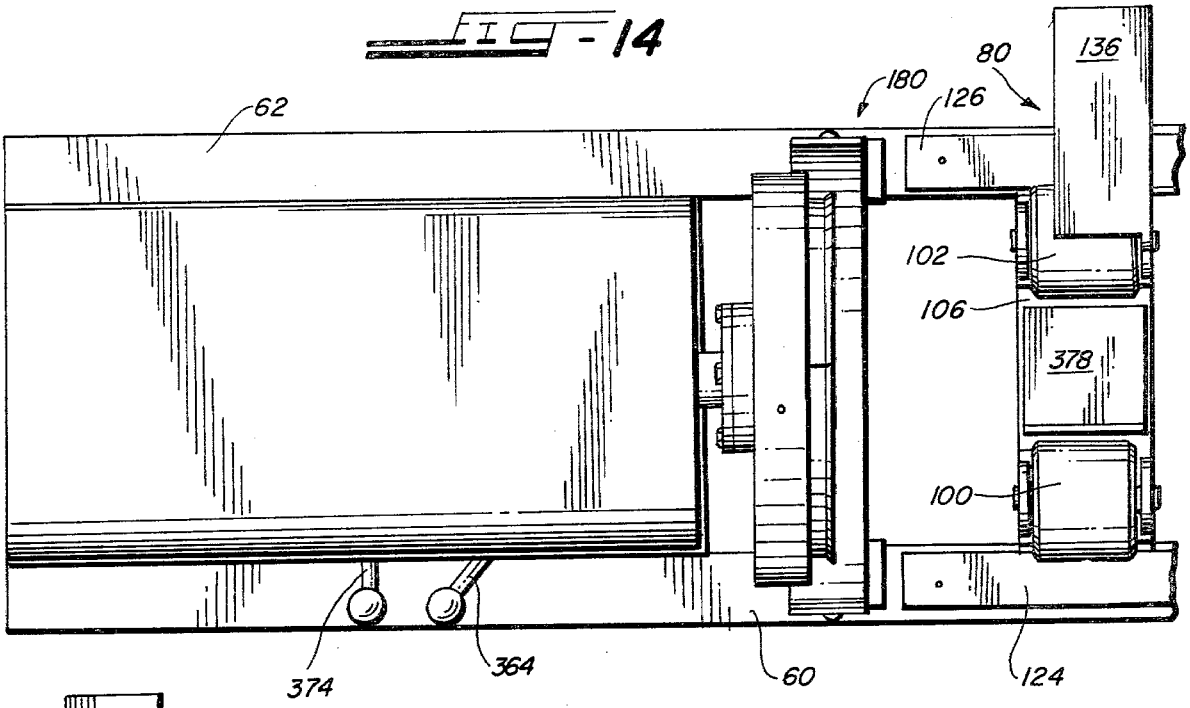
FIG. 14 is a top plan view looking down on the left end showing the right end of the apparatus.
Figure 15:
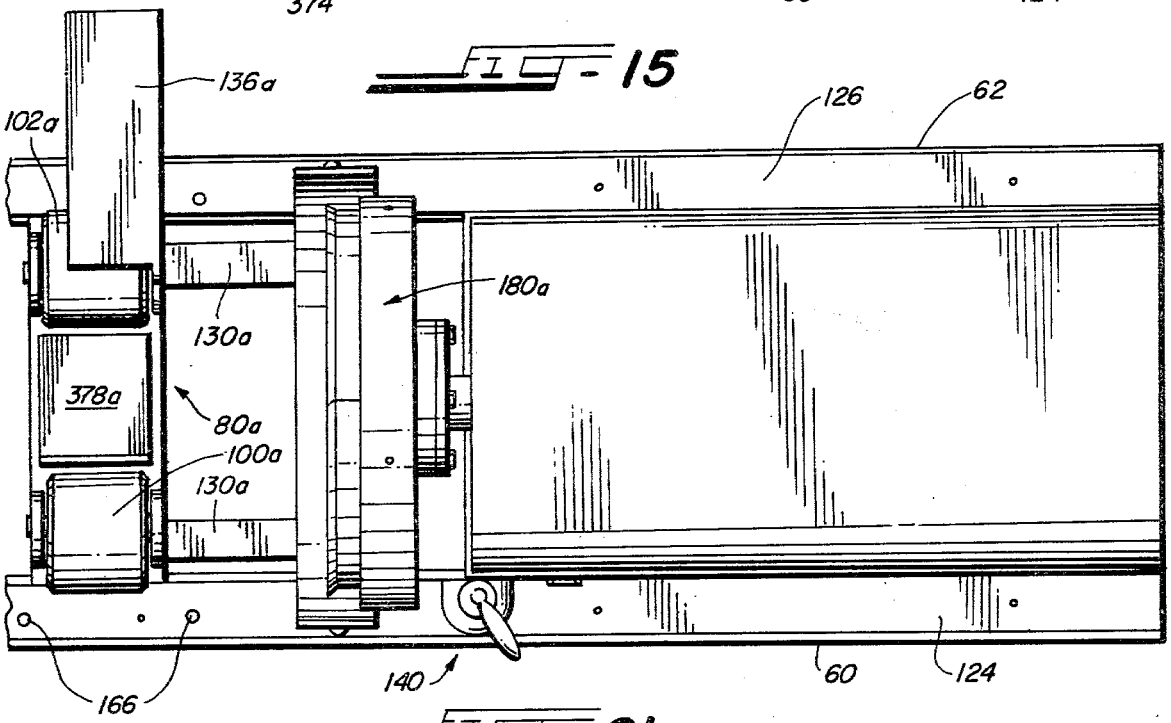
FIG. 15 is a top plan view similar to FIG. 14 but showing the right end of the apparatus.

The movable platform assembly 110 includes a base plate 130 (FIG. 3) fastened to the cross plate 114 and shiftable therewith. A locking pin assembly 140 (FIGS. 8 and 11) mounted on the base plate 130 includes a pin 144 secured in a bearing 146 for vertical shifting movement. The bearing 146 is formed with an internal chamber 150 coaxial with the pin 144 and through which the pin extends. A confined spring 154 encircling and coaxial with the pin 144 stressingly bears upon an upper annular shoulder 158 of the wall defining the chamber 150 and upon a collar 160 secured to the pin 144 whereby the spring 154 biases the pin 144 downwardly, a shown in FIG. 11 so that the pin end 166 presses and rides on the hold-down rail 124. The latter is provided with an array of spaced holes 168 extending along a path which the end 166 of the pin 144 traverses as the shiftable assembly 110 travels along the guide rail 118 so that the end-capping assembly **180*a*** may be conveniently locked in any of several selectible positions.

A pair of laterally spaced end-cap-forming and shaping assemblies 180 and **180*a* are mounted at the left and at the right of the apparatus beyond the respective roll-supporting assemblies 80 and 80*a*. Each is of essentially identical construction, corresponding components being identified by the same number but with the components at the right carrying a suffix "a". As shown in FIG. 2, the end-cap-forming assembly 180 includes an end plate 184 extending essentially normally to a longitudinal axis of the apparatus. A ring 186 includes an annular flange 188 which intersects the end plate 184 and extends as a ring-like sector normal to the surface thereof. At its inwardly directed roll-facing end, the flange 188 is flared outwardly to form an annular lip 190 serving as a radially enlarged guide surface to facilitate sleeve-like engagement with and centering of the ring 186** about the end of the roll.

Figure 5:
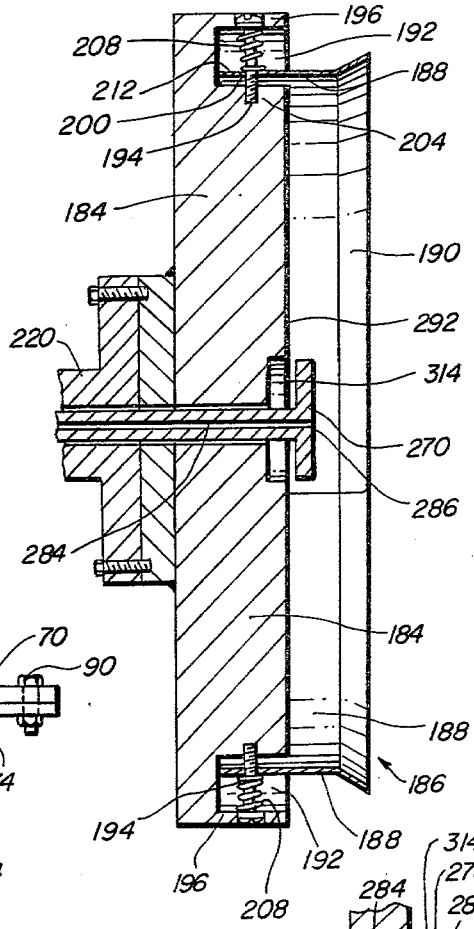
FIG. 5 is an enlarged cross-sectional view taken substantially on the lines 5—5 of FIG. 4 and showing a vacuum plate which holds the paper disc preparatory to application to a roll end.

In the example of the invention shown, the alignment and sleeving of the ring 186 over the end of the roll is further facilitated by providing the flange 188 with a limited degree of mobility in a plane normal to its axial center. As shown in FIG. 5, the plate 184 is formed with an annular slot 192 into which the flange 188 of the ring 186 is received. The flange 188 is held in the slot 192 by screws 194 passing through the outer wall 196 of the slot 192 and through corresponding holes 200 in the flange 188. The ends of the screws 194 are threaded into the body 204 of the plate itself. Each screw 194 carries an encircling coiled spring 208 confined between the annular wall 196 bounding the slot 192 and the outer surface 212 of the flange 188 so that the ring 186 is shiftable radially for resilient and tensioned alignment.

Figure 6:
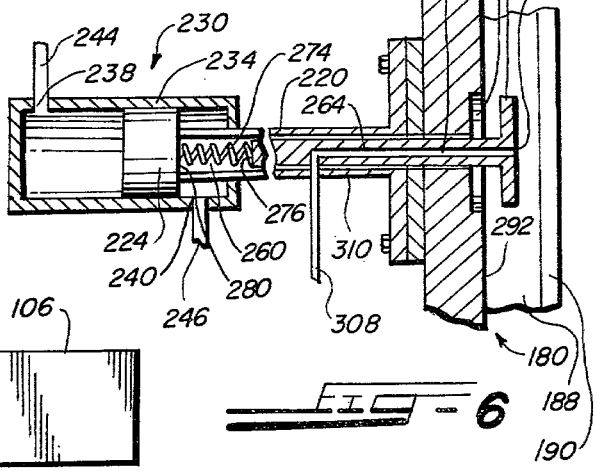
FIG. 6 is an enlarged, fragmentary, cross-sectional view, with parts cut away, taken substantially on the lines 6—6 of FIG. 2 and showing the mechanism for shifting the end-capping assembly to engage with and to retract from the ends of a roll to be end capped.
Figure 8:
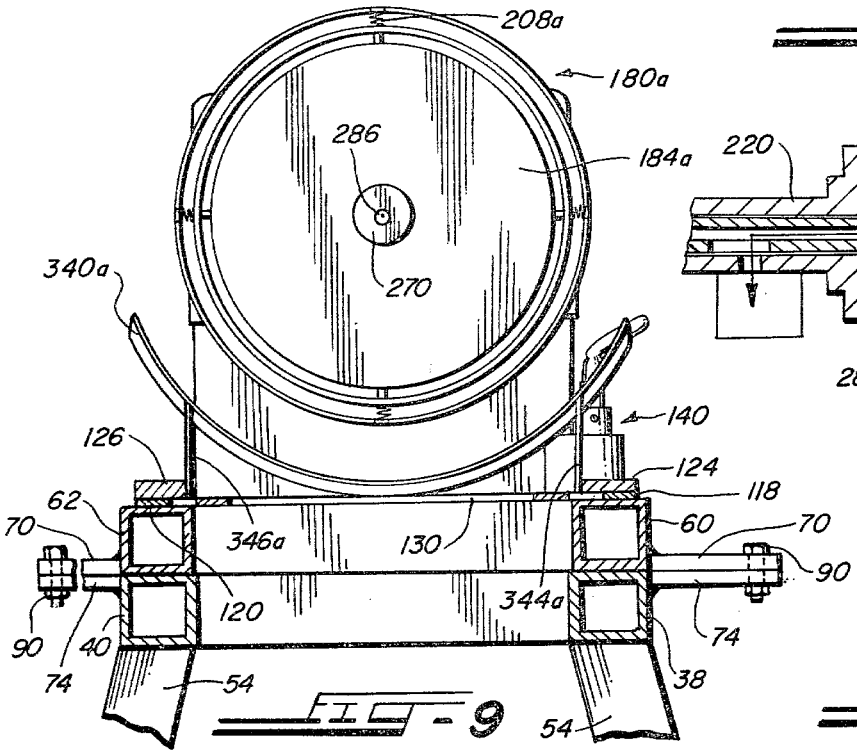
FIG. 8 is an end view taken substantially on the lines 8—8 of FIG. 1 and corresponding generally to FIG. 4 but illustrating the opposite end of the apparatus.
Figure 10:
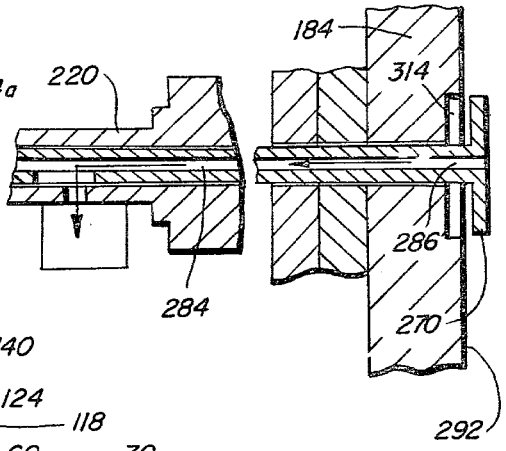
FIG. 10 is an enlarged fragmentary cross-sectional view taken substantially on the lines 10—10 of FIG. 4 and showing details of the disc-supporting vacuum plate.
Figure 9:
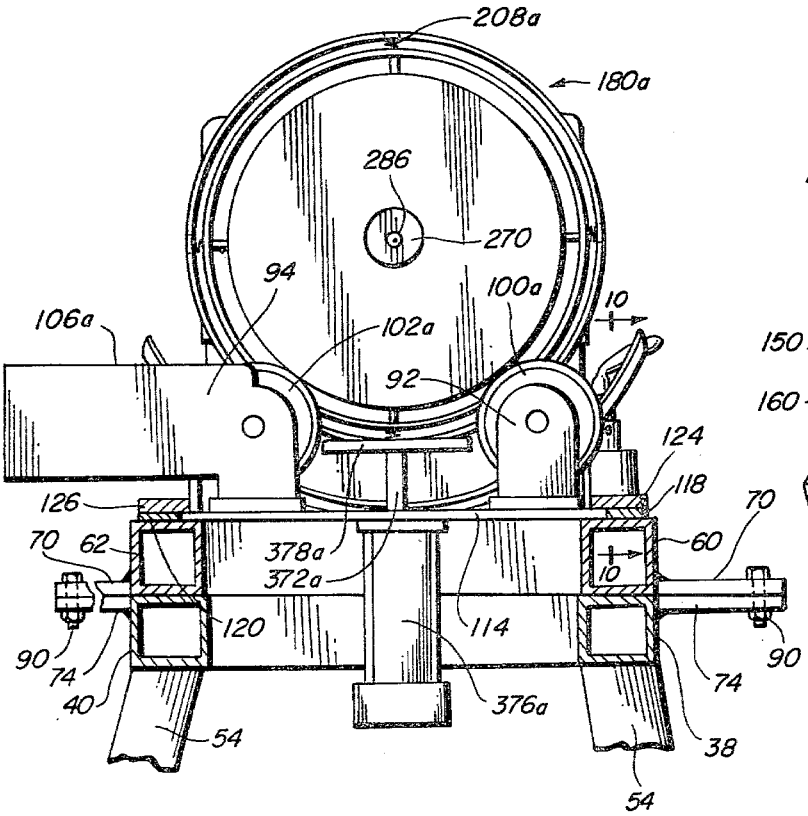
FIG. 9 is an end view taken substantially on the lines 9—9 of FIG. 1, and corresponding generally to FIG. 7, but illustrating the opposite end of the apparatus.

As illustrated schematically in FIG. 6, the end cap forming assembly 180 is carried on a shaft 220 connected to a piston 224 of a piston and cylinder assembly 230. The cylinder wall 234 is provided with suitable input and exhaust ports 238 and 240, conduits 244 and 246, a pump 250 (FIG. 22) and a control valve 256 by which the piston 224 and the shaft 220 connected thereto are shiftable longitudinally on the frame to move the end cap forming assembly 180 toward and from the end of a roll of sheet stock supported on the apparatus.

Figure 22:
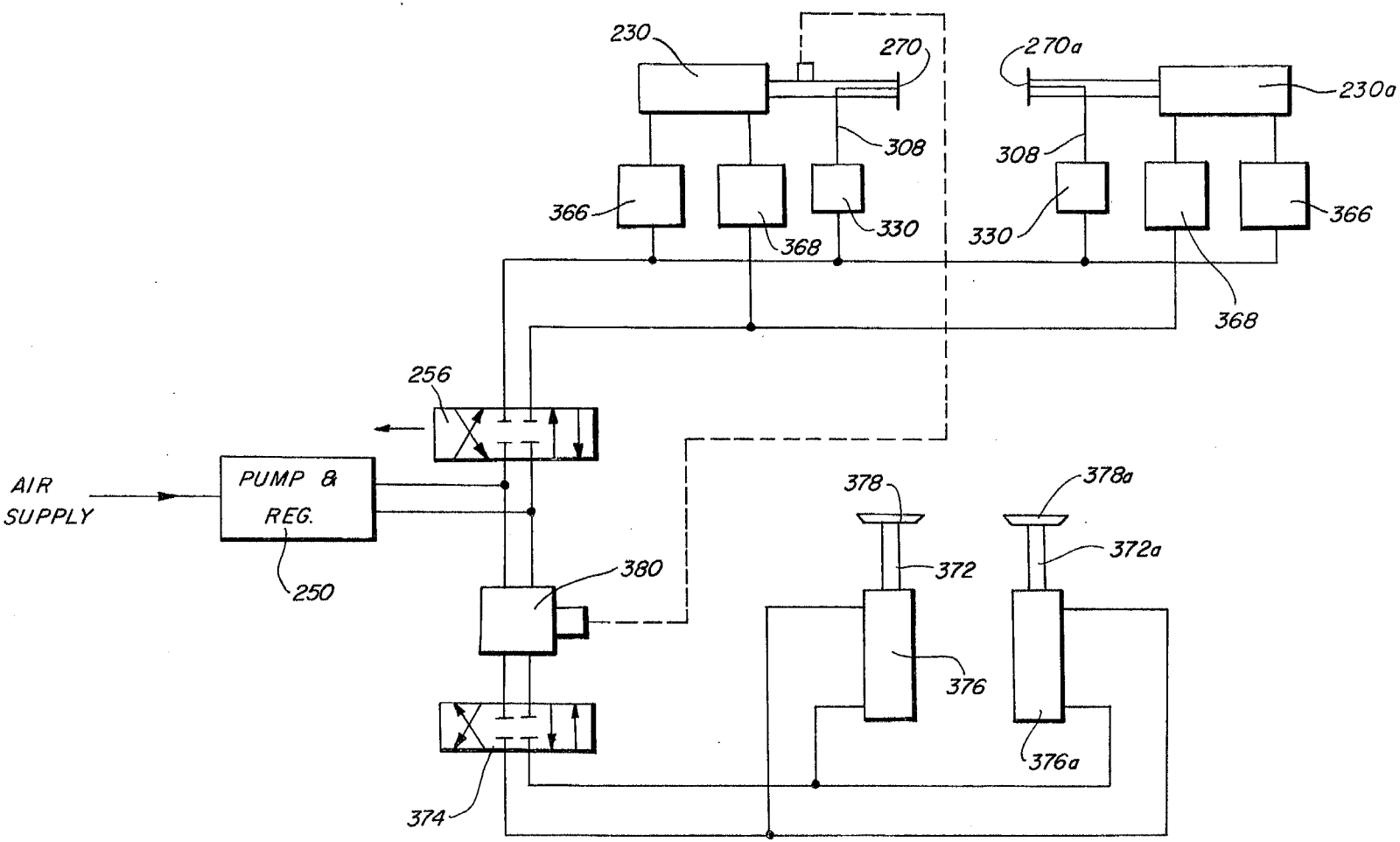
FIG. 22 is a schematic diagram illustrating the pneumatic system by which the various components of the apparatus are moved and controlled.

The shaft 220 is formed with an internal coaxial bore 260 and a rod 264 slidable in the bore 260. At its end projecting from the bore 260 the rod 264 carries a radially enlarged flange 270, and a spring 274 is interposed between the other end 276 of the rod 264 and a face 280 of the piston 224. The rod 264 is provided with an axial duct 284 having one end 286 open to atmosphere at the vacuum plate 270 and communicating at its other end to a vacuum lead 308 connected through the bounding wall 310 of the principal shaft 220, as indicated in FIG. 6. The vacuum line 308 is connected to a vacuum pump 330 (FIG. 22). The end plate 184 is formed with a recessed section 314 at its center for accommodating the vacuum plate 270 when the latter is pushed inwardly toward the end-cap forming assembly so that the outer planar surface of the vacuum plate 270 is flush with the surface 292 of the end plate 184.

Figure 16:
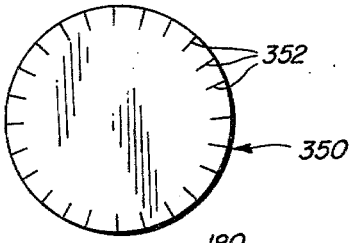
FIG. 16 is a front elevational view of the disc which is used as an end cap.
Figure 17:
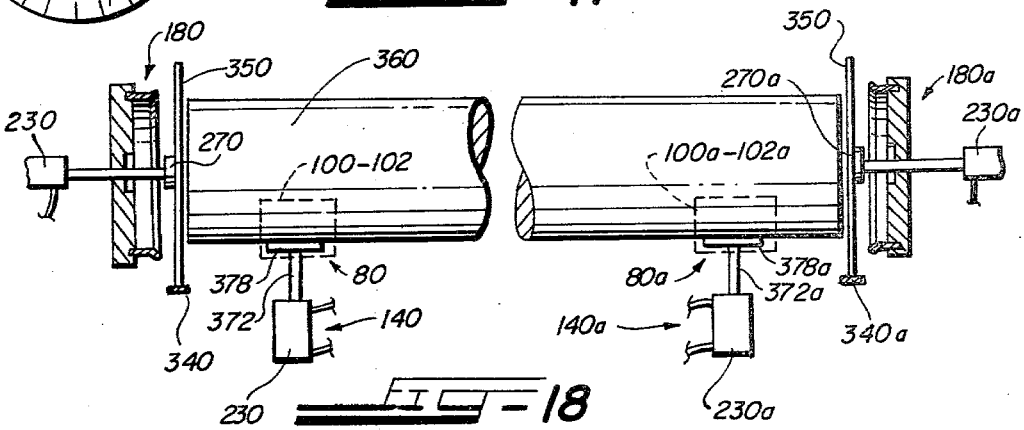
FIGS. 17, 18 and 19 illustrate schematically the several steps involved in positioning and applying discs as end caps to the opposed ends of a roll of sheet stock, FIG. 17 illustrating the apparatus prior to approach of the end assemblies, FIG. 18 illustrating the apparatus during and at the completion of disc application, and FIG. 19 illustrating the disc applied as end caps and the end plate assemblies in their retracted positions.

As shown in FIGS. 2 and 3, a trough-like band 340 opening upwardly and supported on a pair of legs 344 and 346 is aligned vertically in substantial correspondence with the vacuum plate 270 so that a circular disc 350 formed with radial edge cuts 352 (FIG. 16) resting on the band 340 and held to the vacuum plate 270, as indicated in FIG. 17, will be properly oriented for securement to the end of a roll of sheet stock 360 when the latter is supported on the cradle assemblies 80 and 80*a*. The end-cap-forming assemblies 180 and 180*a* including the disc support band 340 and the vacuum assist mechanism have been described above with reference to the components located at the left end of the apparatus as viewed in FIG. 1. It will be understood, however, that a corresponding set of components of essentially identical construction and arrangement and operating in synchronism with the left hand set is mounted at the right end of the apparatus. The left end assembly is fixed on the frame 34 while, the right assembly is shiftable longitudinally along the frame, as previously described.

Figure 21:
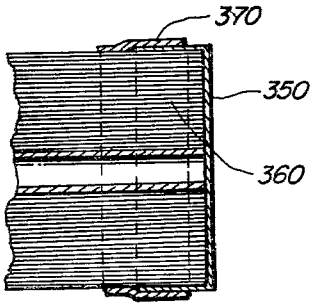
FIG. 21 is a cross sectional view taken substantially on the lines 21—21 of the FIG. 20 and showing a band of retaining tape for securing the end caps in place.
Figure 18:
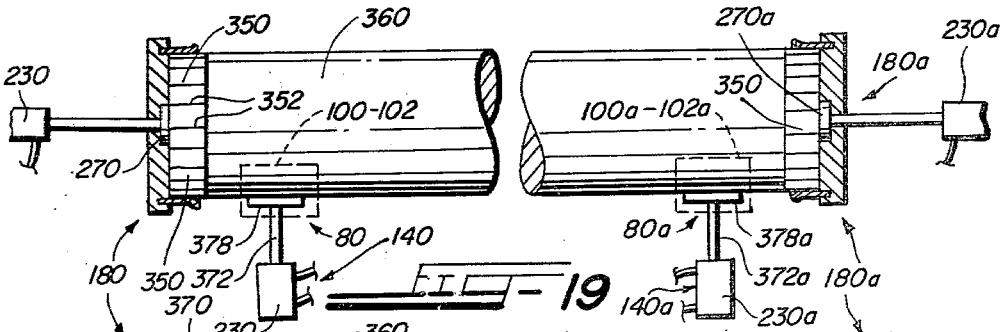
Figure 19:
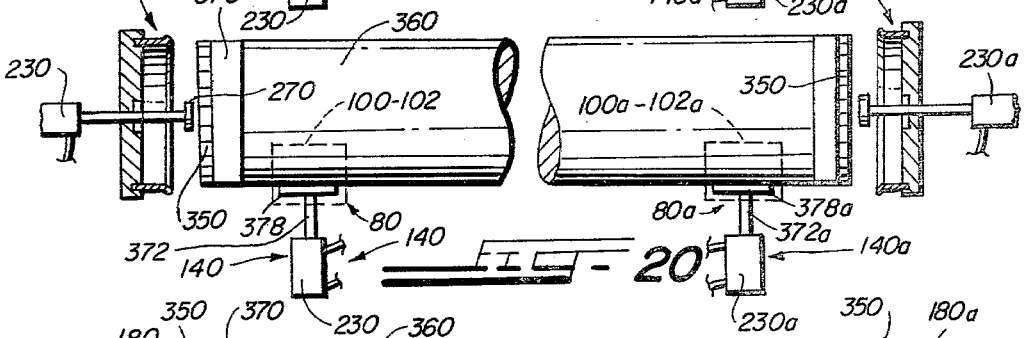
Figure 20:
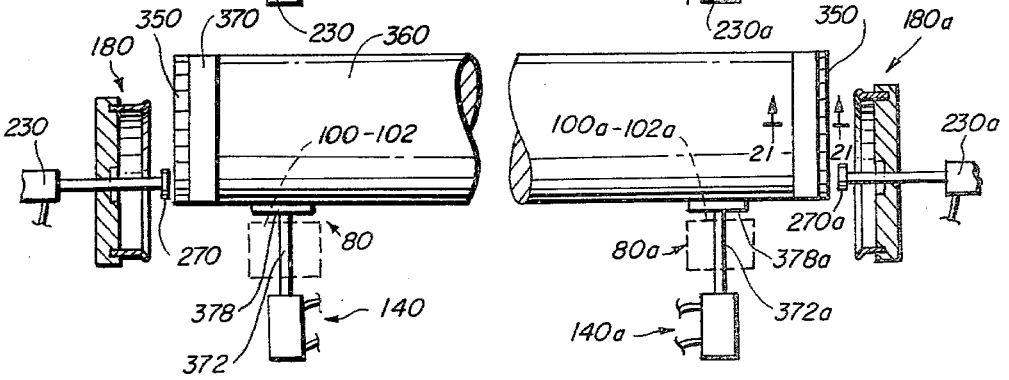
FIG. 20 is a front elevational view indicating schematically the mechanism by which the capped roll is lifted from its cradle upon completion of the capping operation.

The method of using the apparatus of the invention involves several relatively simple steps. A roll 360 of sheet stock material is placed in position between the two end cap forming assemblies 180 and 180*a* and on the rollers 100 and 102 of the cradle assemblies 80 and 80*a*. A circular disc 350 is placed in position against the vacuum plate 270 to rest on the band 340, as indicated in FIG. 17. A valve control lever 364 is then actuated to apply fluid pressure to each of the end-cap-forming assemblies 180 and 180*a* to urge the assemblies toward one another, whereupon the rings 186 and 186*a* engage the discs 350 and urge them against the end faces of the roll stock 360. A two-speed control 366, 368 is provided through the valve 256 (FIG. 22). As the end-cap-forming assemblies 180, 180*a* continue to move inwardly, the ends of the roll 360 enter into the rings 186 and, concurrently, the discs 350 are shaped or formed about the roll end, as shown schematically in FIG. 18. Then, as the forming assemblies 180 and 180*a* are retracted from the ends of the roll, suction is cut off from the vacuum plate 270 and the shaped and formed disc 350 is left attached to the roll stock as a cap (FIG. 19). In order to retain the end cap firmly in place a tape 370 is wound around the marginal end portion of the cap roll end, as indicated in FIG. 20 and in the cross sectional view of the FIG. 21. With the capping operation completed, lift pistons 372 and 372*a* beneath the roll or cradle assemblies 80 and 80*a* are actuated through a valve control lever 374 which applies pressure through lift cylinders 376 and the roll of stock material is lifted free of the rollers 100 and 102 on piston carried plates 378, 378*a*. The roll 360 is then pushed rearwardly onto the support bars 106 and 106*a*. A hydraulic control 380 interlock (FIG. 22) is provided so that the roll lifters 372, 372*a* are inoperative unless the end capping assemblies 180, 180*a* are in their retracted positions. The interlock means is shown schematically in FIG. 22.

While, for purposes of disclosure, specific preferred embodiments of the invention have been illustrated and described in detail, many changes, modifications and variations may be made without departing from the spirit of the invention, and all such changes, modifications and variations are included within the appended claims.

What is claimed is:

1. Apparatus for applying end caps to end faces at each of opposed ends of a roll of sheet stock, said apparatus comprising, a generally horizontally-extending, elongated frame, cradle means carried on said frame for supporting a roll of sheet stock thereon to extend longitudinally therealong, said cradle means includes low friction means to facilitate rotation of said roll about a longitudinal axis thereof while supported on said frame, a pair of longitudinally spaced end-cap-shaping assemblies including generally parallel end plate means having surfaces facing corresponding end faces of the roll and extending essentially normally to a longitudinal axis thereof, for abutment against the end faces of the roll, slide rail means carried on said frame and extending longitudinally between said end-cap-shaping assemblies, one of said assemblies being slidably shiftable along a substantial lineal expanse of said slide rail means, means for selectively adjusting lineal spacial separation between opposed said end-cap-shaping assemblies for accommodating rolls of different overall length on said frame, and means for locking said shiftable end-cap-shaping assembly in each of a plurality of selectible positions along said slide rail means, means supporting said end plate means on said frame endwise of, in alignment with, and generally paralleling respective corresponding end faces of the roll, means for releasably supporting end-cap-forming discs between said end plate means and end faces of the roll, preparatory to applying the discs as caps to the opposed ends of the roll, said means for releasable supporting said discs including vacuum plate means for contacting of said discs thereagainst, and aspirator means for controlling air passage through said vacuum plate means, means for shifting said end plate means longitudinally along said frame toward the roll to engage the end-cap-forming discs and to urge the discs to abut corresponding end faces of the roll, said means for shifting said end plate means including fluid controlled piston and cylinder means to move said end plate means selectively to approach and to recede from the ends of the roll, and valve means for fluid-flow control, means for deforming the discs at bounding margins thereof to overlie the end faces and peripheral annular end portions of the roll to provide caps therefor, said means for deforming the discs comprising annular flange means projecting normally of said end plate means, said flange means including a ring-like sector having a fixed internal radius substantially equal to but not less than a radius of the roll of sheet stock at ends thereof, said means for shifting said end plate means constituting means to urge said flange means against the discs and to position said ring-like sector into sleeve-like, encircling, stressing engagement over ends of the roll, to conform peripheral margins of the discs into contiguous contact with the roll at annular edge portions thereof, said annular flange means include an annular lip integral with and flared outwardly from said ring-like sector at an inwardly-directed roll-facing extremity thereof, thereby to guide and to center said ends of the roll into and within said ring-like sector, spring means resiliently supporting said annular flange means to permit shifting thereof in a plane paralleling said abutment surface of said end plate means thereby to facilitate alignment of said fixed ring-like sector with and entry of the end of a roll therewithin.

2. The structure as set forth in claim 1 and further comprising means for lifting said roll to clear said cradle means preparatory to removal of said roll from said frame, and hydraulic control means and interlock means operable to prevent lifting of the roll from said cradle means unless said end-cap-shaping assemblies are in positions retracted from the ends of the roll.

* * * * *